United States Patent [19]

Tippin et al.

[11] 4,182,145

[45] Jan. 8, 1980

[54] KEY-OPERATED LOCKS

[75] Inventors: Arthur D. Tippin, Tamworth; Malcolm J. White, Whittington, both of England

[73] Assignee: Chubb & Son's Lock & Safe Co. Ltd., London, England

[21] Appl. No.: 871,984

[22] Filed: Jan. 24, 1978

[30] Foreign Application Priority Data

Jan. 24, 1977 [GB] United Kingdom ..... 2779/77

[51] Int. Cl.[2] ..... E05B 65/06

[52] U.S. Cl. ..... 70/134; 292/153

[58] Field of Search ..... 70/129, 134, 355; 292/166, 153

[56] References Cited

U.S. PATENT DOCUMENTS

| | | | |
|---|---|---|---|
| 318,388 | 5/1885 | Parsons | 70/134 |
| 537,694 | 4/1895 | Mann et al. | 70/355 |

FOREIGN PATENT DOCUMENTS

| | | | |
|---|---|---|---|
| 1063486 | 8/1959 | Fed. Rep. of Germany | 70/129 |

*Primary Examiner*—Kenneth Dorner

*Attorney, Agent, or Firm*—Andrus, Sceales, Starke & Sawall

[57] ABSTRACT

A key-operated security lock of the kind including a key-identification mechanism, a thrower turned by the key and a deadbolt, has the deadbolt isolated from the thrower, and includes means operable only by correct identification of the key for connecting the thrower to the deadbolt and for removing a stop preventing retraction of the deadbolt from its extended position. The said means preferably includes a lever pivoted to the deadbolt and formed with a locking projection capable of engagement with a complementary recess in a runner driven along a path parallel with that of the bolt by co-operation with the thrower to connect the thrower to the deadbolt as a result of pivoting of the lever which is prevented by a further member in the form of a pivoted arm which holds the pivoted lever in a position such that its locking projection is clear of its recess until the pivoted arm is allowed to turn by the key-identification mechanism. The key-identification mechanism may comprise detainers having slots which, when a correct key is employed, are lined up to allow the entry of a probe which, in its turn, allows movement of the pivoted arm and the thrower may be formed with a cam which holds the pivoted arm in a position such that the probe is clear of the detainers of the key-identification mechanism until the thrower reaches an angular position in which the slots are lined up by the use of a correct key.

12 Claims, 3 Drawing Figures

KEY-OPERATED LOCKS

BACKGROUND OF THE INVENTION

This invention relates to key-operated locks and is particularly concerned with a construction of lock suitable for security purposes, e.g. for securing external doors in shops, offices, warehouses and private homes. With a normal construction of a key-operated lock, if an incorrect key is used, the mechanism of the lock prevents this from turning and there is a natural temptation for the user of the key to apply excessive force. Generally speaking, therefore, the components of the lock have to be designed to absorb load or even break under excessive load to prevent undue force being transmitted to the naturally vulnerable key recognition members. The disadvantage of this is that at least some force is still transmitted to the key recognition members and damage is likely, if not necessary, in order to maintain security when an incorrect key is used.

SUMMARY OF THE PRESENT INVENTION

A key-operated lock in accordance with the invention includes the normal components of a key-identification mechanism, a thrower turned by the key and a deadbolt which is operated by the use of a correct key, but contrary to the normal practice, the deadbolt is isolated from the thrower and the lock also includes means operable only by correct identification of the key for connecting the thrower to the deadbolt and also for removing a stop preventing retraction of the deadbolt from its extended position. This means that if an incorrect key is used, the deadbolt remains isolated from the thrower which is able to turn under the action of the key, but without otherwise affecting the operative components of the lock. Thus, not only does the deadbolt remain in the extended position, but the stop which prevents retraction of the deadbolt from this position and which is an essential component of a security lock, continues to hold the deadbolt in this position. On the other hand, when a correct key is used, the identification of this by the key-identification mechanism of the lock operates the means for connecting the thrower to the deadbolt and also for removing the stop, so that turning of the key then operates the lock in the normal way. There is thus no need to design the components of the lock to absorb force applied by means of the key, nor is there the risk of forcing the locking mechanism.

The means for connecting the thrower to the deadbolt conveniently includes a pivoted lever formed with a locking projection capable of engagement with a complementary recess as a result of pivoting of the lever, which is prevented by a further member until the further member is allowed to move as the result of the identification of a correct key by the key-identification mechanism. Consequently, unless a correct key is used, the further member is prevented from movement and this, in its turn, prevents pivoting of the lever and thus prevents the completion of the connection between the thrower and the deadbolt.

Preferably the key-identification mechanism comprises detainers having slots which, when a correct key is employed, are lined up to allow the entry of a probe which then allows movement of the further member. This in its turn allows pivoting of the lever to complete the connection referred to above. Such a form of key-identification mechanism is by no means essential, however, and other forms of such mechanism such as a magnetically-operated mechanism may alternatively be used, the function of the mechanism being to allow the said further member to move only when a correct key is used and to prevent such movement when an incorrect key is used.

In one convenient construction, the pivoted lever is pivoted to the deadbolt and the further member is in the form of a pivoted arm which holds the pivoted lever in a position such that its locking projection is clear of its recess until the pivoted arm is allowed to turn by the key-identification mechanism. The recess with which the locking projection on the pivoted lever co-operates is preferably formed in a runner driven along a path parallel with that of the bolt by co-operation with the thrower. Consequently, when the locking projection is in engagement with the recess in the runner, the deadbolt is locked to the runner and operation of the key to turn the thrower moves the runner and the deadbolt in unison. On the other hand, unless the deadbolt and the runner are locked together as the result of the use of a correct key, the two parts remain quite separate and although use of an incorrect key will cause the thrower to turn and hence the runner to move, the runner remains isolated from the deadbolt and the latter is not operated.

Instead of the recess being in a runner driven along a path parallel with that of the bolt, various alternatives are possible. For example, the recess may be formed in the thrower so that the pivoted lever locks the deadbolt directly to the thrower without the intermediary of the runner, as soon as identification of a correct key is complete. Yet again, the recess may be formed in an intermediate member other than the runner just described, e.g. in a rotary member or in a runner driven along a path perpendicular to that of the deadbolt and connected to the latter by means of a bell crank. This last mentioned form of construction is particularly useful in reducing the overall dimensions of a lock in a direction parallel with movement of the deadbolt.

When a key-identification mechanism comprising slotted detainers is used in conjunction with a pivoted arm for controlling movement of the pivoted lever, the thrower may be formed with a cam which holds the pivoted arm in a position such that the probe is clear of the detainers of the key identification mechanism until the thrower reaches an angular position in which the slots are lined up by the use of a correct key. When this angular position is reached, the pivoted arm is allowed to move so that the probe enters the lined-up slots in the detainers and the remainder of the operation proceeds as previously described.

As mentioned originally, one essential component of the lock is the stop for preventing retraction of the deadbolt from its extended position, this stop being removed upon correct identification of the key. Although a separate stop member may be used for this purpose, the mechanism as a whole can be simplified when using a locking lever pivoted to the bolt by means of a construction in which, as long as the locking projection on the lever is clear of its recess, another part of the lever is in engagement with a fixed abutment so as positively to prevent movement of the deadbolt. As soon as the locking projection enters its recess, however, this part of the lever moves away from the abutment and thus removes the stop preventing retraction of the bolt.

A further desirable capability of a security lock is that when the deadbolt is retracted, it should be locked in the retracted position so that it cannot be moved to the extended position, either inadvertently, or by means of an incorrect key. Such a capability may be provided in a construction in accordance with the invention by means of a locking member operated by rotation of the thrower beyond the position corresponding to full retraction of the bolt. This locking member may conveniently be formed on the pivoted arm, the thrower being formed with a further cam which, when the thrower passes the angular position corresponding to full retraction of the bolt, causes the pivoted arm to move so that the locking member enters a recess in the bolt.

DETAILED DESCRIPTION OF THE PREFERRED EMBODIMENT

Figure 1:
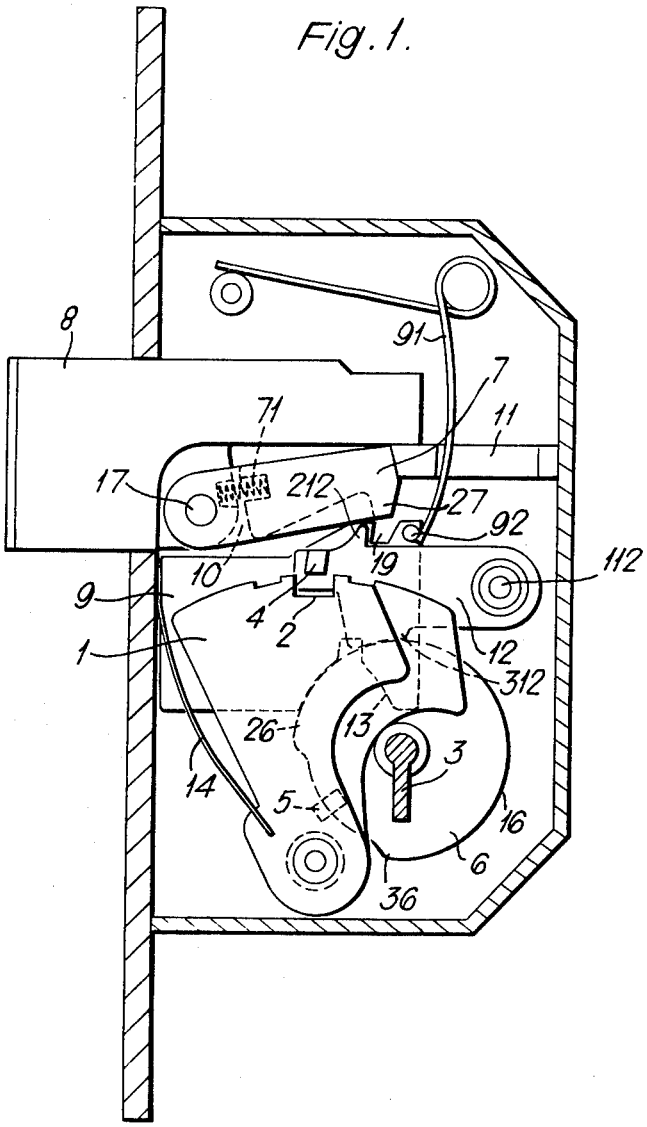
FIG. 1 is an elevation with the cover removed showing the lock with the deadbolt extended.

The essential components of the lock are a key-identification mechanism comprising detainers 1, a thrower 6 turned by a key 3, against which the detainers are held by a spring 14, and a deadbolt 8 which is isolated from the thrower, but can be connected to it by way of a movable member such as a pivoted lever 7 and a runner 9 driven by the thrower 6 against the action of a spring 91 acting against a pin 92.

The lever 7 is pivoted to the bolt 8 at 17, being spring loaded clockwise, by means of a spring 71 and is formed with a locking projection 27. In the position illustrated in FIG. 1, the end of the lever 7 remote from its pivot is in engagement with an abutment 11 to form a stop preventing retraction of the bolt 8. The lever 7 is held in the position shown by the droparm 12 pivoted to the frame of the lock at 112 and formed with an projection 212 which engages the lever 7 to hold it in the position shown.

The droparm 12 has a further projection 312 which engages with a cam surface 16 on the thrower 6. The greater part of this cam surface forms a circular arc about the axis of the thrower 6 so that, during the initial part of the rotation of the thrower 6, the droparm 12 continues to be held in the position shown. In this position, a probe 4 extending from the drop arm 12 is held clear of the upper surface of the detainers 1. When the thrower 6 is turned in a clockwise direction through approximately 90° from the position shown, the portion 312 of the droparm 12 reaches a step 26 in the cam surface of the thrower 6, thus allowing the probe 4 assisted by the spring 71 to move into contact with the surface of the detainers 1. By this stage, the positioning of the detainers 1 by the key 3 has been completed and provided the correct key has been used, the slots 2 are correctly aligned and the presence of the step 26 allows the probe 4 to enter the slots 2. This allows the droparm 12 to turn in an anti-clockwise direction about its pivot 112, thus allowing corresponding pivoting movement (in a clockwise direction) of the locking lever 7, thus bringing its projection 27 into engagement with a recess 19 in the runner 9 to form a coupling means at the same time, allowing the right hand end of the lever 7 to move clear of the abutment 11.

Further rotation of the key 3 brings a peg 5 on the thrower 6 into engagement with a talon form 13 on the runner 9, driving the latter towards the right and causing corresponding movement of the bolt 8 by means of the connection just described between the projection 27 on the locking lever 7 and the recess 19 in the runner 9, the obstruction caused by the abutment 11 having previously been removed as also described.

Figure 2:
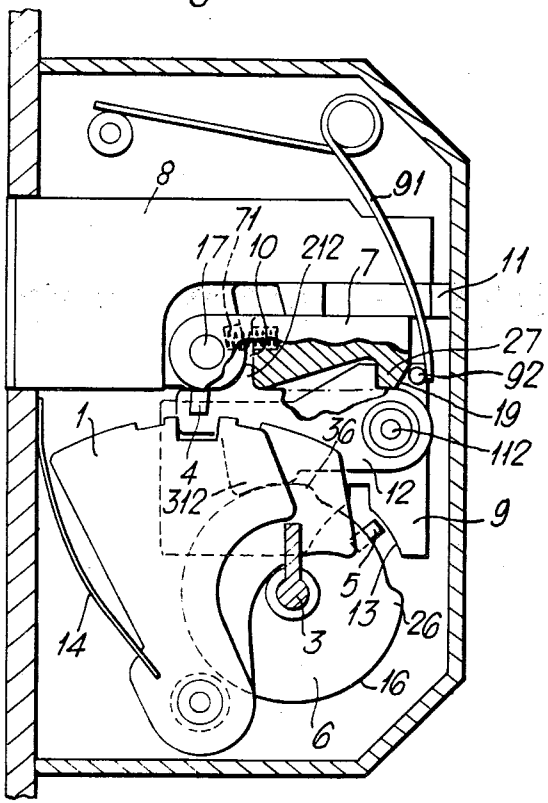
FIG. 2 is a similar view but with the deadbolt retracted, a small part of the mechanism being broken away for purposes of illustration.

Still further rotation of the key 3 in the same direction to the position of FIG. 2 brings a step 36 on the cam surface of the thrower 6 into engagement with the portion 312 of the droparm 12, thus causing this to turn slightly in a clockwise direction and thereby lifting the projection 212 into engagement with a slot 10 in the bolt assembly and thereby to lock the bolt in the retracted position. The locking is merely the reverse of the operation just described.

Figure 3:
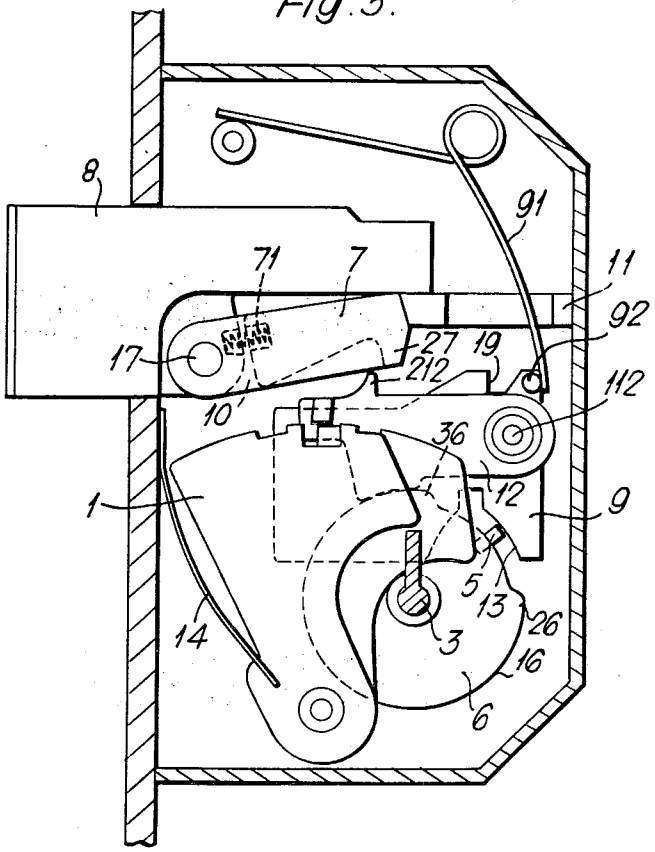
FIG. 3 is a view corresponding to FIG. 1 but illustrating attempted operation with an incorrect key.

Until the time of identification of a correct key, the bolt 8 is isolated from the runner 9 and hence from the thrower 6 by the fact that there is no connection between the pivoted locking lever 7 and the runner. It is only when a correct key is identified that the droparm 12 is allowed to fall, assisted by the spring 71, thus making the connection between the runner 9 and the bolt 8, thus allowing the movement of the runner 9 to be transmitted to the bolt 8 so as to retract it. If, however, an incorrect key is used, as illustrated in FIG. 3, operation proceeds up to the point where the step 26 on the thrower cam allows the probe 4 to move into contact with the upper surfaces of the detainers 1. Owing to the fact that the key is incorrect, however, the slots 2 are not lined up and thus do not permit the probe 4 to enter, so that the droparm 12 is not allowed to fall and the locking lever 7 is not allowed to move into engagement with the runner 9 or indeed out of engagement with the abutment 11. Further rotation of the key nevertheless causes the thrower peg to engage with the runner 9 so as to move it across as previously described, but since the runner 9 is not connected to the bolt 8, the latter remains in its extended or thrown position in which it is deadlocked by means of the engagement of the locking lever 7 with the abutment 11. Consequently, it is possible for the incorrect key to make a complete turn without meeting any obstruction so there is no risk of damage to the components of the lock or of forcing the lock.

When the key has made just over half a turn, (i.e. it reaches the position of FIG. 3) the peg 5 leaves the talon form 13, thus freeing the runner 9 which returns to the left to the position illustrated under the influence of the spring 91. This permits the operation to be repeated and, in fact, the key may be turned any number of times without operating the lock and without damaging it in any way.

We claim:

1. In a key-operated security lock comprising a key-identification mechanism, a thrower turned by a key and a deadbolt having a retracted position and an extended position, the improvement wherein said deadbolt is isolated from said thrower, and including a stop preventing retraction of said deadbolt from said extended position and operating means responsive only to identification of a correct key for coupling said thrower to said deadbolt and for removing said stop, said operating means including a movable member operatively associated with one of said deadbolt and thrower, coupling means interposed between said movable member and the other of said deadbolt and thrower for coupling said thrower to said deadbolt as a result of movement of said movable member, and means responsive to identification of a correct key by said key identification mechanism for allowing said movable member to move to couple said deadbolt and thrower together and for preventing such movement in the event an incorrect key is used to isolate said deadbolt from said thrower.

2. A security lock according to claim 1 wherein said coupling means comprises a locking projection-complementary recess coupling means interposed between said movable member and the other of said deadbolt and thrower.

3. A security lock according to claim 2 wherein said locking projection-complementary recess coupling means includes a locking projection formed on said movable member and capable of engagement with a complementary recess operatively associated with the other of said deadbolt and thrower.

4. A security lock according to claim 3 in which said operating means includes a pivoted lever as said movable member, a locking projection formed on said pivoted lever and capable of engagement with a complementary recess for coupling said thrower to said deadbolt as a result of pivoting of said lever, and a further movable member prevented from movement by said key-identification mechanism until the identification of a correct key by said key-identification mechanism, said further movable member engaging said pivoted lever and allowing said lever to pivot when said member moves.

5. A security lock according to claim 2 in which said key-identification mechanism comprises detainers having slots, and a movable probe connected to said further movable member, said detainers engaging a key and, when a correct key is employed, being lined up to allow the entry of said probe and hence to allow movement of said further member.

6. In a key-operated security lock comprising a key-identification mechanism, a thrower turned by a key and a deadbolt, the improvement wherein said deadbolt is isolated from said thrower and including a lever pivoted to said deadbolt, a locking projection formed on said pivoted lever, a pivoted arm prevented from pivoting movement by said key-identification mechanism until the identification of a correct key by said key identification mechanism, said pivoted arm engaging said pivoted lever and, on identification of a correct key, allowing said pivoted lever to fall so that said locking projection engages a complementary recess for coupling said thrower to said deadbolt.

7. A security lock according to claim 6 and including a runner co-operating with said thrower and driven along a path parallel with that of said deadbolt by co-operation with said thrower, said runner being formed with said recess co-operating with said locking projection on said pivoted lever whereby to connect said runner to said deadbolt.

8. A security lock according to claim 1 in which said key-identification mechanism comprises detainers having slots, and a movable probe connected to said pivoted arm, said detainers engaging a key and, when a correct key is employed, being lined up to allow the entry of said probe and hence to allow movement of said pivoted arm.

9. A security lock according to claim 8 in which said thrower is formed with a cam which engages said pivoted arm and holds said pivoted arm in a position such that said probe is clear of said detainers of said key identification mechanism until said thrower reaches an angular position in which said slots are lined up by the use of a correct key.

10. A security lock according to claim 6 and including a fixed abutment engaged by said pivoted lever when said pivoted lever is in a position in which said locking projection is clear of its recess, said abutment thereby functioning to prevent retraction of said bolt, pivoting movement of said lever to a position in which said locking projection enters said recess causing said pivoted lever to move away from said fixed abutment so as to permit retraction of said bolt.

11. A security lock according to claim 6 and further including a locking member for locking said deadbolt in said rectracted position and a part on said thrower for operating said locking member by rotation of said thrower beyond the position of said thrower corresponding to full retraction of said deadbolt.

12. A security lock according to claim 11 in which said locking member is formed on said pivoted arm and said thrower is formed with a cam surface which, when said thrower passes an angular position corresponding to full retraction of said deadbolt, causes said pivoted arm to move so that said locking member enters a recess in said deadbolt.

* * * * *